US011473430B2

(12) United States Patent
Foresto et al.

(10) Patent No.: US 11,473,430 B2
(45) Date of Patent: Oct. 18, 2022

(54) TURBOMACHINE ASSEMBLY COMPRISING FAN BLADES WITH AN EXTENDED TRAILING EDGE

(71) Applicant: SAFRAN AIRCRAFT ENGINES, Paris (FR)

(72) Inventors: Paul Antoine Foresto, Moissy-Cramayel (FR); Vivien Mickaël Courtier, Moissy-Cramayel (FR); Stéphane Roger Mahias, Moissy-Cramayel (FR); William Henri Joseph Riera, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/416,897

(22) PCT Filed: Dec. 20, 2019

(86) PCT No.: PCT/FR2019/053234
§ 371 (c)(1),
(2) Date: Jun. 21, 2021

(87) PCT Pub. No.: WO2020/128384
PCT Pub. Date: Jun. 25, 2020

(65) Prior Publication Data

US 2022/0056803 A1 Feb. 24, 2022

(30) Foreign Application Priority Data

Dec. 21, 2018 (FR) ..... 1873734

(51) Int. Cl.
*F01D 5/14* (2006.01)
*F01D 5/30* (2006.01)
*F01D 11/00* (2006.01)

(52) U.S. Cl.
CPC ..... *F01D 5/145* (2013.01); *F01D 5/3007* (2013.01); *F01D 11/008* (2013.01);
(Continued)

(58) Field of Classification Search
CPC ..... F01D 5/145; F01D 5/3007; F01D 11/008; F01D 5/147; F01D 11/001;
(Continued)

(56) References Cited

U.S. PATENT DOCUMENTS 9,399,922 B2 * 7/2016 Lamboy ..... F01D 5/3038
2013/0156592 A1 * 6/2013 Kray ..... F01D 5/282 416/229 A (Continued)

FOREIGN PATENT DOCUMENTS

EP 3 045 661 A1 7/2016
EP 3 284 905 A1 2/2018

(Continued)

OTHER PUBLICATIONS

International Search Report and Written Opinion dated Mar. 31, 2020, issued by the International Searching Authority in application No. PCT/FR2019/053234.

(Continued)

*Primary Examiner* — Woody A Lee, Jr.
*Assistant Examiner* — Eric A Lange
(74) *Attorney, Agent, or Firm* — Sughrue Mion, PLLC

(57) ABSTRACT

The invention relates to a turbomachine assembly (1) comprising a fan (2) and a booster drum-type part (3), the fan (2) comprising:—blades (20) comprising an airfoil (23) and an extension (30) mounted on and attached to the trailing edge (25) of the airfoil (23),—a fan (2) disc (10) and—a series of inter-blade platforms (16), the extension (30) of each blade (20) extending beyond the downstream face (14) of the fan (2) disc (10) in the direction of the upstream edge (4) of the (Continued)

part (3) and covering, at least partially, the cavity (6) between the fan (2) and the part (3).

20 Claims, 3 Drawing Sheets

(52) U.S. Cl.
CPC .... *F05D 2220/36* (2013.01); *F05D 2240/304* (2013.01); *F05D 2240/55* (2013.01); *F05D 2300/10* (2013.01); *F05D 2300/603* (2013.01)

(58) Field of Classification Search
CPC ..... F05D 2240/80; F05D 2220/36; F05D 2240/304; F05D 2240/55; F05D 2300/10; F05D 2300/603
See application file for complete search history.

(56) References Cited

U.S. PATENT DOCUMENTS

2015/0377027 A1 12/2015 Maguire et al.
2016/0076552 A1* 3/2016 Anderson ..... F04D 29/324 416/230

FOREIGN PATENT DOCUMENTS

JP 2011-69286 A 4/2011
WO 2017/006054 A1 1/2017

OTHER PUBLICATIONS

Search Report dated Nov. 13, 2019, issued by the National Institute of Industrial Property in French application No. FR 1873734.

* cited by examiner

TURBOMACHINE ASSEMBLY COMPRISING FAN BLADES WITH AN EXTENDED TRAILING EDGE

CROSS REFERENCE TO RELATED APPLICATIONS

This application is a National Stage of International Application No. PCT/FR2019/053234 filed Dec. 20, 2019, claiming priority based on French Patent Application No. 1873734 filed Dec. 21, 2018, the entire contents of each of which being herein incorporated by reference in their entireties.

FIELD OF THE INVENTION

The invention relates generally to the field of bypass gas turbine engines, and more particularly to that of fans of these gas turbine engines and their interaction with the inlet of the primary duct.

TECHNOLOGICAL BACKGROUND

From upstream to downstream in the direction of gas flow, a bypass gas turbine engine generally comprises a fan, a primary annular flow duct and a secondary annular flow duct. The mass of air sucked in by the fan is therefore divided into a primary flow which circulates in the primary flow duct, and a secondary flow which is concentric to the primary flow and circulates in the secondary flow duct.

The primary flow duct passes through a primary body comprising one or more stages of compressors, for example a low-pressure compressor and a high-pressure compressor, a combustion chamber, one or more turbine stages, for example a high-pressure turbine and a low-pressure turbine, and a gas exhaust nozzle.

The fan comprises a rotor disc bearing a plurality of blades the root of which are engaged and held in substantially axial grooves formed at the periphery of the disc. The grooves are separated from each other by teeth. These blades are connected at their radially internal end to inter-blade platforms which are arranged in the extension of an inlet cone of the fan and are configured to delimit the annular air inlet duct in the fan, from the inner side.

As is known per se, immediately downstream of the fan, at the intake of the primary duct the gas turbine engine comprises a part which, according to the embodiment of the fan, can correspond to a drum of the booster (low-pressure compressor), which corresponds to the inner shroud of the booster on which are fixed the rotating blades of the booster, an inner shroud of an IGV (acronym for Inlet Guide Vane, that is, the first stator stage of the booster in the primary body of a gas turbine engine) or even a rotating spacer which is formed by an annular flange extending between the fan and the drum of the booster and which rotates at the same speed as the fan.

To prevent any mechanical interaction between the fan disc and this part immediately downstream, functional clearance is provided between the downstream face of the disc of fan and an upstream edge of the part. But this clearance forms a cavity disrupting the flow by generating recirculation of the gaseous flow downstream of the root of the blades of fan and a leak rate.

To reduce this cavity, the platforms are dimensioned so as to extend beyond the downstream face of the disc of fan to cover this cavity at least partially. Yet, this solution does not omit the cavity over the entire circumference of the fan, to the extent where it is necessary to leave an opening downstream of the grooves to allow for insertion and fastening of the blades of fan on the disc of fan. As a consequence, the part of the cavity which terminates downstream of the blades of fan remains partially open.

To protect the operation of the booster of this degraded flow the inner shroud of the IGV must be dimensioned so as to adopt an aerodynamically robust design. Robust means that the ferrule must be capable of supporting poor-quality flows without creating losses or excessive detachment. The compensation of this dimensioning is that the efficiency of the blading of such an IGV is less than that of classic IGVs. The presence of these cavities therefore degrades the operation of the booster

PRESENTATION OF THE INVENTION

An aim of the invention therefore is to propose a gas turbine engine wherein the operation of the booster is not degraded by limiting or even by eliminating recirculation of gas and the leak rate downstream of the root of the blades of fan.

For this, the invention proposes an assembly of a gas turbine engine having an axis of revolution and comprising, from upstream to downstream in the direction of gas flow in the gas turbine engine, a fan and a part, the part extending immediately downstream of the fan and comprising an upstream edge separated from the fan by a cavity, the fan comprising:

- a series of blades including an airfoil comprising a trailing edge and a shield mounted on and fixed to the trailing edge of the airfoil,
- a disc of fan having a radial face configured to receive the blades, and a downstream face extending opposite the upstream edge of the part, and
- a series of inter-blade platforms, each platform being mounted on and fixed to the radial face, each platform being configured to cover the radial face and extend beyond the downstream face of the disc of fan in the direction of the upstream edge of the part so as to cover the cavity at least partially, the assembly being characterised in that the shield mounted on and fixed to the trailing edge of the airfoil is an extension of each blade of fan and this extension extends beyond the downstream face of the disc of fan in the direction of the upstream edge of the part and covers at least partially the cavity.

Some preferred but non-limiting characteristics of the assembly described hereinabove are the following taken individually or in combination:

- wherein the part comprises a rotor, especially a rotating spacer or a drum of a low-pressure compressor.
- all or some of the extensions cover the upstream edge of the part.
- the part comprises a stator, especially an inner shroud of an IGV.
- all or some of the extensions extending up to the upstream edge of the part without covering said upstream edge.
- the assembly also comprises a gasket mounted on and fixed to the extension and configured to fill the cavity between the extension and the upstream edge of the part.
- the airfoil has an aerodynamic surface and all or some of the extensions extend from the platform adjacent to the blade, over a height less than a height of said aerodynamic surface, where the height of the aerodynamic surface corresponds to a dimension, according to an axis radial to the axis of revolution passing through the trailing edge, between said platform and a tip of the blade and where the height of the extension corresponds to a dimension, according to this axis radial, between the platform and an outer radial end face of the extension.

the part also exhibits a radially outer upstream end, configured to separate a primary flow entering the part of a secondary flow enclosing the part, and a first outer radius corresponding to a radial distance between the radially outer upstream end and the axis of revolution, the extension having a second outer radius, corresponding to a radial distance between the outer radial end face of the extension and the axis of revolution and the outer radius of the extension being substantially equal to the outer radius of the part.

the extension has a nose, configured to axially extend the trailing edge of the airfoil downstream, said nose being more rounded than the trailing edge of the airfoil.

the assembly also comprises, for each blade of fan, a transition piece fixed to an outer radial face of the extension, said transition piece having a scalable form between an internal radial end where the transition piece has a form and a thickness substantially identical to those of the outer radial face of the extension, and an outer radial end where the transition piece has a form and a thickness substantially identical to those of the trailing edge of the airfoil.

BRIEF DESCRIPTION OF THE DRAWINGS

Other characteristics, aims and advantages of the invention will emerge more clearly from the following detailed description and in conjunction with the appended drawings given by way of non-limiting examples and in which.

DETAILED DESCRIPTION OF AN EMBODIMENT

Figure 1:
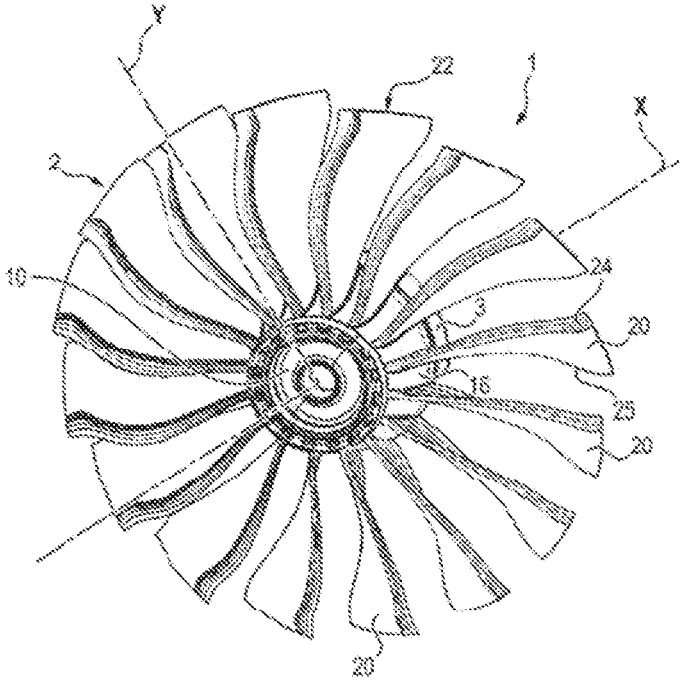
FIG. 1 illustrates an embodiment of an example of a gas turbine engine assembly according to the invention.

In the present application, upstream and downstream are defined relative to the direction of normal flow of gas in the gas turbine engine 1. In addition, the axis of revolution of the gas turbine engine is called the axis X of radial symmetry of the gas turbine engine. The axial direction corresponds to the direction of the axis X of the gas turbine engine, and a radial direction is a direction perpendicular to this axis and passing through it. Similarly, an axial plane is a plane containing the axis X of the gas turbine engine and a radial plane is a plane perpendicular to this axis X and passing through it. The tangential (or circumferential) direction is a direction perpendicular to the axis X and not passing through it. Unless otherwise stated, internal (or inside) and outer (or outside) respectively are used in reference to a radial direction such that the part or the internal face (i.e. radially internal) of an element is closer to the axis X than the part or the outer face (i.e. radially external) of the same element.

From upstream to downstream, an assembly 1 of a gas turbine engine has especially a fan 2 and a part 3. The part 3 can comprise a drum of the booster, an inner shroud of an IGV or even a rotating spacer.

The fan 2 comprises a fan disc 10 having an upstream face, a downstream face 14 and a radial face 12. It bears a plurality of blades 20 of a fan 2 connected to inter-blade platforms 16, 20. Axial grooves, separated in pairs by teeth, are formed in the radial face 12 of the disc 10.

The blades 20 are connected at their radially internal end to inter-blade platforms 16. Each platform 16 has an upstream end, configured to extend in the region of the face upstream of the fan disc 10, and a downstream end configured to be opposite the part 3 extending immediately downstream of the fan 2. The platform 16 radially delimits the flow duct in the fan 2 to the inside such that each blade 20 has an aerodynamic surface corresponding to the part of the blade 20 extending in the gaseous flow. The radially internal limit of the aerodynamic surface is defined by the platform 16.

The aerodynamic surface of the blade 20 has a main direction of extension, defining the axis of extension Y of the blade 20 which is substantially radial to the axis of revolution X of the gas turbine engine. The aerodynamic surface also exhibits a height H corresponding to a distance between a lower limit of the aerodynamic surface and a tip 22 of the blade 20, in the region of an intersection between the trailing edge 25 and the lower limit. The lower limit corresponds to the interface between the airfoil 23 and the adjacent platform 16.

Each blade 20 comprises a root 21 configured to be inserted into a groove of the fan disc 10, a tip 22 (or apex) and an airfoil 23 having a leading edge 24, a trailing edge 25, an intrados wall 26 and an extrados wall 27. The leading edge 24 is configured to extend opposite the gas flow entering the gas turbine engine. It corresponds to the front part of an aerodynamic profile which faces the air flow and which divides the air flow into an intrados flow and an extrados flow. The trailing edge 25 per se corresponds to the rear part of the aerodynamic profile, where the intrados and extrados flows join.

Irrespective of the embodiment of the part 3, it comprises an upstream edge 4 configured to extend in the extension of the platform 16.

The downstream face 14 of the fan disc 10 and the upstream edge 4 of the part 3 are separated by a functional clearance creating an annular cavity 6 terminating in the flow duct.

This cavity 6 is covered at least partially by the platforms 16. For this, each platform 16 extends beyond the downstream face 14 of the fan disc 10, in the direction of the upstream edge 4 of the part 3. When the part 3 is a rotor and rotates at the same speed as the fan disc 10, typically when the part 3 comprises a drum of the booster or a rotating spacer, the downstream end of the platform 16 can be fixed to the upstream edge 4 of the part 3. As a variant, when the part 3 comprises a stator, typically an inner shroud of an IGV, the downstream end of the platform 16 extends opposite the upstream edge 4 of the part 3 without making contact with the latter.

To limit the risk of recirculation of the gaseous flow and leak rate, each blade 20 of fan 2 comprises an extension 30, mounted on and fixed to the trailing edge 25 of its airfoil 23 and which extends beyond the downstream face 14 of the fan disc 10 in the direction of the upstream edge 4 of the part 3. The function of the extension 30 therefore is to extend the trailing edge of the airfoil 23 beyond the downstream face 14 of the disc 10 to cover the cavity 6 at least partially. However, the extension 30 also does not penalise mounting the blades 20 on the fan disc 10, as it does not block access to the grooves.

In the areas of the blades 20 on which it is fixed, the extension 30 therefore forms the trailing edge of the blade 20 since it is in this region where the intrados and extrados flows which bypass the blade 20 join together, and are not in the region of the trailing edge 25 of the airfoil 23 anymore. However, in the other areas of the airfoil 23 which are optionally not covered by the extension 30, the trailing edge 25 of the airfoil 23 also forms the trailing edge of the blade 20.

The extension 30 can be mounted on and fixed to the trailing edge 25 of the airfoil 23 by any means, for example by adhesion. The type of adhesive 40 selected will depend on the material constituting the airfoil 23 and the extension 30. For example, an epoxy adhesive 40 can be utilised in the event where the airfoil 23 and/or the extension 30 comprises a metal of aluminium, titanium, Inconel type, or a composite material comprising a fibrous reinforcement densified by a polymer matrix.

The extension 30 is fixed to the trailing edge 25 of the airfoil 23 so as to make contact with the platform 16, and more particularly its outer radial face. However, the extension 30 does not cover the entire trailing edge 25 of the airfoil 23. In other words, a height h of the extension 30 is less than the height H of the aerodynamic surface of the blade 20, given that the height h of the extension 30 corresponds to the dimension of the extension 30 between its radial internal and outer faces 34, 35 according to the axis Y. In this way, the extensions 30 do not needlessly penalise the mass of the fan 2 and extend solely over the height necessary to ensure they are held on the airfoils 23 and cover the cavity 6.

The extension 30 comprises a nose 31 configured to axially extend the trailing edge 25 of the airfoil 23 downstream, an intrados wing 32 configured to partially cover the intrados wall 26 of the airfoil 23 and an extrados wing 33 configured to partially cover the extrados wall 27 of the airfoil 23. The intrados and extrados wings 32, 33 therefore extend upstream when the extension 30 is fixed to the airfoil 23, without reaching the leading edge 24 of the airfoil 23. The internal radial face 34 of the extension 30 is also configured to be supported against the platform 16.

The axial length of each wing 32, 33 is selected so as to ensure that the extension 30 is held adequately on the blade 20. For example, at any point of the height h of the extension 30 each wing of the extension 30 covers the airfoil 23 over a length of between 5% and 20% of a line of the airfoil 23 at this point, where the line corresponds to the distance between the leading edge 24 and the trailing edge 25 of the airfoil 23 at this point.

Figure 3:
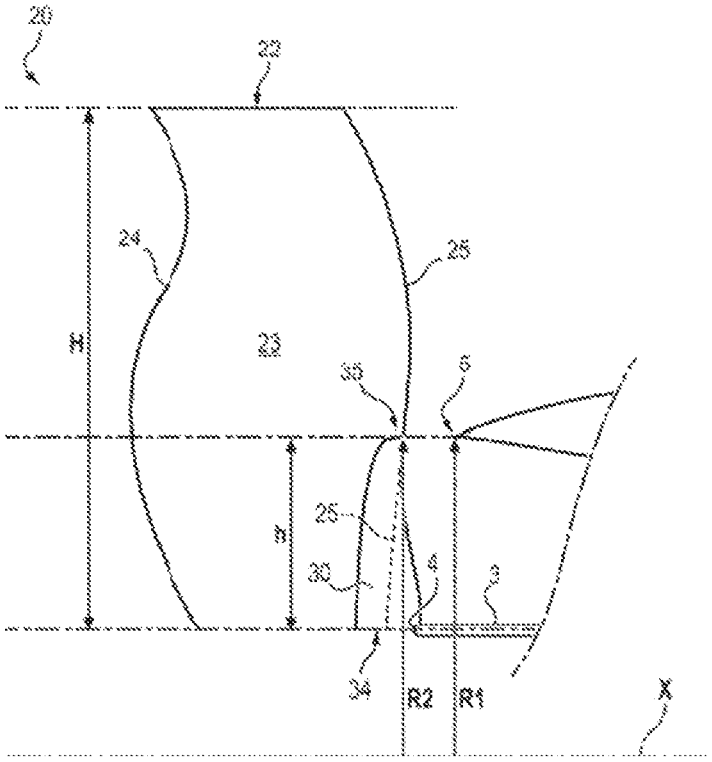
FIG. 3 is a side elevation of an embodiment of a blade of fan which can be utilised in a gas turbine engine assembly according to the invention.

The blade 20 therefore has a surplus of line in the region of the platform 16, this surplus of line being due to the presence of the extension 30. The extension 30 therefore creates a humped form in the region of the trailing edge of the blade 20 relative to the trace of the trailing edge 25 of the airfoil 23 devoid of extension 30 (see the diagram in FIG. 3).

Figure 4:
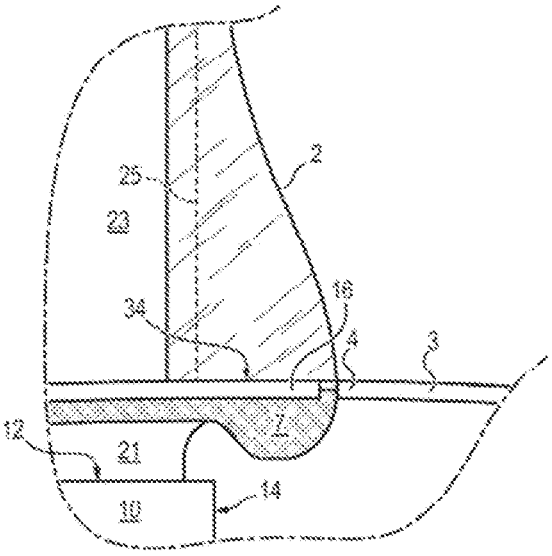
FIG. 4 is a partial schematic side view of a first embodiment of a blade of fan and the upstream edge of a part which can be utilised in a gas turbine engine assembly according to the invention.

In a first embodiment (FIG. 4) the extension 30 extends up to the upstream edge 4 of the part 3 without covering it. The extension 30 therefore fully covers the cavity 6, but not the part 3.

This embodiment is adapted so that the part 3 comprises a rotor (booster drum or rotating spacer) or a stator (inner shroud of an IGV), since the extension 30 does not make contact with the part 3.

If needed, this embodiment makes it possible to omit the rotating spacer. In fact, the initial function of a rotating spacer is to reduce the size of the cavity 6 between the inner shroud of an IGV and the fan 2 in a gas turbine engine. But because of the addition of extensions 30 on the airfoils 23 in combination with the platforms 16 which are dimensioned so as to cover the cavity 6, it is now unnecessary to reduce the size of the cavity 6 by adding such a rotating spacer. Consequently, fastening extensions 30 to the trailing edges of the airfoils 23 reduces the mass of the gas turbine engine assembly 1 by omitting the rotating spacer along with the associated fastening means (generally, an annular flange and a bolted joint).

In a second embodiment (FIG. 5), the extension 30 covers the upstream edge 4 of the part 3. In other words, the extension 30 intersects and passes through a plane radial to the axis of revolution and passing through the upstream edge 4 of the part 3.

This embodiment is more particularly adapted when the part 3 comprises a rotor (booster drum or rotating spacer), with relative movements between the extension 30 and the rotor being reduced.

The fan 2 can also comprise a gasket 7, mounted on and fixed to the extension 30 and configured to fill the cavity 6. In the first embodiment, the seal 7 is configured to abut with the upstream edge 4 of the part 3. In the second embodiment, the seal 7 is fixed to the extension 30 so as to extend between the extension 30 and the upstream edge 4 of the part 3 by being housed in the cavity 6.

Irrespective of the embodiment, the seal 7 is fixed to the internal radial face 34 of the extension 30, in the zone of the extension 30 which covers the cavity 6. In other words, the seal 7 is fixed to the part of the extension 30 which overshoots the downstream face 14 of the fan disc 10.

The seal 7 is preferably made of elastomer material, rubber for example.

The seal 7 can be fixed only against the internal radial face 34 of the extension 30 without covering the intrados and extrados walls 26, 27 of the airfoil 23 or the intrados and extrados wings 32, 33. As a variant, on the contrary the seal 7 can partially cover the intrados and extrados walls 26, 27 to provide sealing for said walls 26, 27. In this case, the seal 7 extends below the platform 16, that is, outside the flow duct. The part of the seal 7 which is fixed to the extension 30 and the part of the seal 7 which partially covers the intrados and extrados walls 26, 27 can be monobloc, or by way of variant can comprise two separate seals 7.

In the first embodiment, the seal 7 abuts with the downstream end of the nose 31 of the extension 30 to ensure adequate sealing between the fan disc 10 and the part 3.

Figure 5:
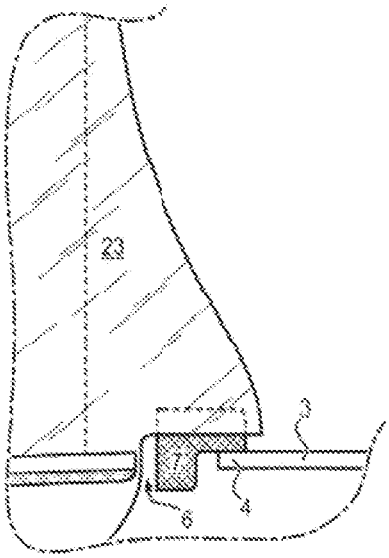
FIG. 5 is a partial schematic side view of a second embodiment of a blade of fan and the upstream edge of a part which can be utilised in a gas turbine engine assembly according to the invention.

In the second embodiment, only part of the internal radial face 34 of the extension 30 which overlaps the upstream edge 4 of the part 3 can be covered by the seal 7, while the downstream end of the nose 31 can be devoid of seal 7. Alternatively, the seal 7 can extend up to the downstream end of the nose 31 of the extension 30 but without exceeding it, as illustrated in FIG. 5. If needed, the seal 7 can have excess thickness in the region of the cavity 6 to fill said cavity 6, and a thinned zone in the part configured to be positioned opposite, or even be supported, against the upstream edge 4 of the part 3.

The advantage of fastening an extension 30 mounted on and fixed to the trailing edge 25 of the airfoil 23 is producing this extension 30 from a material separate to that of the rest of the airfoil 23. The extension 30 in fact does not play a structural role such that the restrictions it is likely to undergo are different to those undergone by the airfoil 23. It can accordingly have an elasticity modulus lower than the material constituting the airfoil 23 and/or a lower density.

This is particularly advantageous when the airfoil 23 is made of a composite material comprising a fibrous reinforcement densified by a matrix, in particular a polymer matrix. In fact, the fibrous reinforcement is generally formed from a fibrous preform obtained by three-dimensional weaving with scalable thickness, the matrix then being vacuum-injected by means of processes of RTM (Resin Transfer Moulding) type, or again VARTM (Vacuum Resin Transfer Moulding). This technology does not directly produce a trailing edge 25 having a fine and rounded thickness as it leaves the mould. On the contrary, the trailing edge 25 is generally truncated and has a substantially angular cross-section which favours cracks and impairs the general acoustics of the fan 2. Fastening the extension 30 onto the trailing edge 25 therefore covers this angular trailing edge 25 with an envelope made of different material such that its form can be more easily controlled.

The extension 30 can typically be made of metal. For example, the extension 30 can be made of aluminium, to the extent where this metal is low in density. Also, its Young's modulus is not too high, limiting shearing constraints in the adhesive 40 at the interface between the airfoil 23 and the extension 30.

Alternatively, the extension 30 can be made of composite material comprising a bidimensional fabric reinforced by a polymer matrix to limit shearing constraints in the adhesive 40 between the airfoil 23 and the extension 30. In this case, the extension 30 is obtained simply by successive draping of ribbons or filament laying and/or comprises short fibres to achieve lesser thicknesses.

When the airfoil 23 is made of composite material comprising a fibrous reinforcement made from a fibrous preform obtained by three-dimensional weaving with scalable thickness, it also becomes possible to obtain a blade 20 of which the trailing edge 25 is fine and rounded, as opposed to angular and thick trailing edges likely to be obtained with current three-dimensional weaving technologies. The extension 30 therefore also reduces the thickness of the slipstreams of the blade 20 of fan 2 and consequently the performance of the fan 2, but also improves the intake flow of the booster and its first stage of rectifiers by making the flow more uniform, as well as improving the sealing between the fan 2 and the part 3.

Because the aerodynamic sections of the blades 20 of fan 2 are finer towards the tip 22 of the blade 20, it is unnecessary to apply the extension 30 to the entire height H of the aerodynamic surface. The extension 30 therefore preferably extends between the of separation line of the primary and secondary flow and the platform 16 in such a way that only the flow entering the primary body (the booster) benefits from thinning of the trailing edge 25 of the blade 20 due to the extension 30. The outer radius R2 of the extension 30, corresponding to the distance between the outer radial face 35 of the extension 30 and the axis X of revolution, in a radial plane, is therefore substantially equal (around 10%) to the outer radius R1 of the part 3, corresponding to the distance between the radially outer end 5 of the part 3 the farthest upstream of the part 3 (that is, in the region of the separation line of the flows) and the axis X of revolution.

Figure 2:
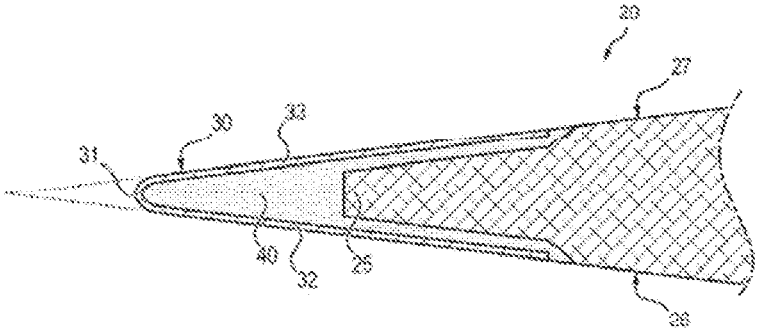
FIG. 2 is a view in transversal section of an embodiment of a trailing edge of a blade of fan which can be utilised in a gas turbine engine assembly according to the invention.

The extension 30 can be mounted on and fixed to the trailing edge 25 of the airfoil 23 by means of conventional fastening techniques for a structural shield on an airfoil 23 made of composite material. In this way, joggling of the intrados and extrados walls 26, 27 of the airfoil 23 can be carried out to make assembly of the extension 30 easier (see FIG. 2). The extension 30 is then mounted on and fixed by means of an adhesive 40 to the machined parts of the airfoil 23.

The transition between the extension 30, of which the nose 31 is rounded and has minimal thickness by comparison with the trailing edge 25 of the airfoil 23 and the angular trailing edge 25 of the airfoil 23 can be formed by means of a transition piece 8 fixed between the outer radial face 35 of the extension 30 and the airfoil 23. This transition piece 8 therefore has a scalable form between its internal radial end where the transition piece 8 has a form and a thickness substantially identical to those of the outer radial face 35 extension 30, and an outer radial end where the transition piece 8 has a form and a thickness substantially identical to those of the airfoil 23. The transition piece 8 can be integrated directly into the extension 30 or by way of variant be mounted on and fixed to the latter.

The invention claimed is:

1. An assembly of a gas turbine engine comprising:

a fan;

a part extending immediately downstream of the fan and comprising an upstream edge separated from the fan by a cavity; and wherein the fan comprises:

a plurality of blades, each blade including an airfoil comprising a trailing edge and a shield mounted on and fixed to the trailing edge;

a fan disc having a radial face configured to receive the blades and a downstream face extending opposite the upstream edge of the part; and a plurality of platforms, each platform being mounted on and fixed to the radial face of the fan disc, each platform being configured to cover the radial face and extend beyond the downstream face of the fan disc towards the upstream edge of the part so as to cover at least partially the cavity;

wherein the shield forms an extension of each blade and comprises a radial internal face that at least partially faces the platform, wherein the radial internal face extends beyond the downstream face of the fan disc towards the upstream edge of the part and covers at least partially the cavity.

2. The assembly of claim 1, wherein the part comprises a rotor.

3. The assembly of claim 1, wherein all or part of the extensions cover the upstream edge of the part.

4. The assembly of claim 1, wherein the part comprises a stator.

5. The assembly of claim 1, wherein all or part of the extensions extend up to the upstream edge of the part without covering said upstream edge.

6. The assembly of claim 1, also comprising a seal mounted on and fixed to the extension and configured to fill the cavity between the extension and the upstream edge of the part.

7. The assembly of claim 1, wherein the airfoil has an aerodynamic surface and all or part of the extensions extend from the platform adjacent to the blade over a height less than a height of said aerodynamic surface, wherein the height of the aerodynamic surface corresponds to a dimension, along a radial axis passing through the trailing edge which is radial to an axis of revolution of the fan, between the platform and a top of the blade, and wherein the height of the extension corresponds to a dimension, along the radial axis, between the platform and an outer radial end face of the extension.

8. The assembly according to claim 7, wherein:

the part also comprises a radially outer upstream end configured to separate a primary flow entering the part of a secondary flow surrounding the part, and a first outer radius corresponding to a radial distance between the radially outer upstream end and an axis of revolution of the fan;

the extension has a second outer radius, corresponding to a radial distance between the outer radial end face of the extension and the axis of revolution; and the first outer radius is substantially equal to the second outer radius.

9. The assembly of claim 1, wherein the extension has a nose configured to axially extend the trailing edge of the airfoil in a downstream direction, said nose being more rounded than the trailing edge of the airfoil.

10. The assembly of claim 1, also comprising, for each blade, a transition piece fixed to an outer radial face of the extension, said transition piece having a scalable form between an internal radial end where the transition piece has a form and a thickness substantially identical to a form and a thickness of the outer radial face of the extension, and an outer radial end where the form and thickness of the transition piece are substantially identical to a form and a thickness of the trailing edge of the airfoil.

11. The assembly of claim 2, wherein the rotor is a rotating spacer or a drum of a low-pressure compressor.

12. The assembly of claim 4, wherein the stator is an inner shroud of an inlet guide vane.

13. The assembly of claim 1, wherein the extension is made of metal or a composite material comprising a bidimensional fabric reinforced by a polymer matrix.

14. The assembly of claim 13, wherein the airfoil is made of a composite material comprising a fibrous reinforcement densified by a matrix.

15. The assembly of claim 6, wherein the seal abuts a downstream end of a nose of the extension.

16. The assembly of claim 6, only part of an inner radial face of the extension, which overlaps the upstream edge of the part, is covered by the seal.

17. The assembly of claim 16, wherein a downstream end of a nose of the extension is devoid of seal.

18. A gas turbine engine comprising the assembly of claim 1.

19. An assembly of a gas turbine engine comprising:

a part extending immediately downstream of the fan and comprising an upstream edge separated from the fan by a cavity; and a fan comprising:

a plurality of blades, each blade including an airfoil comprising a trailing edge and a shield mounted on and fixed to the trailing edge, wherein the shield forms an extension of each blade that extends beyond the downstream face of the fan disc towards the upstream edge of the part and covers at least partially the cavity;

a fan disc having a radial face configured to receive the blades and a downstream face extending opposite the upstream edge of the part;

a plurality of platforms, each platform being mounted on and fixed to the radial face of the fan disc, each platform being configured to cover the radial face and extend beyond the downstream face of the fan disc towards the upstream edge of the part so as to cover at least partially the cavity; and a seal mounted on and fixed to the extension and configured to fill the cavity between the extension and the upstream edge of the part.

20. An assembly of a gas turbine engine comprising:

a part extending immediately downstream of the fan and comprising an upstream edge separated from the fan by a cavity; and a fan comprising:

a plurality of blades, each blade including an airfoil comprising a trailing edge and a shield mounted on and fixed to the trailing edge; wherein the shield forms an extension of each blade that extends beyond the downstream face of the fan disc towards the upstream edge of the part and covers at least partially the cavity;

a fan disc having a radial face configured to receive the blades and a downstream face extending opposite the upstream edge of the part;

a plurality of platforms, each platform being mounted on and fixed to the radial face of the fan disc, each platform being configured to cover the radial face and extend beyond the downstream face of the fan disc towards the upstream edge of the part so as to cover at least partially the cavity; and a transition piece fixed to an outer radial face of each extension, said transition piece having a scalable form between an internal radial end where the transition piece has a form and a thickness substantially identical to a form and a thickness of the outer radial face of the extension, and an outer radial end where the form and thickness of the transition piece are substantially identical to a form and a thickness of the trailing edge of the airfoil.

* * * * *